US005827154A

United States Patent [19]

Gill

[11] Patent Number: 5,827,154

[45] Date of Patent: Oct. 27, 1998

[54] CONCENTRIC/ECCENTRIC EXERCISE APPARATUS

[76] Inventor: Jonathan C. Gill, 3505 Camino Del Rio South, No. 220, San Diego, Calif. 92108

[21] Appl. No.: 676,473

[22] Filed: Jul. 8, 1996

[51] Int. Cl.[6] ..... A63B 23/04

[52] U.S. Cl. ..... 482/9; 482/101; 482/135; 601/35

[58] Field of Search ..... 482/4–9, 94, 97–104, 482/133, 135–138, 148; 601/5, 23, 33–35

[56] References Cited

U.S. PATENT DOCUMENTS

| | | | |
|---|---|---|---|
| 4,535,985 | 8/1985 | Mask | 482/135 |
| 4,998,721 | 3/1991 | Anders et al. | 482/4 |
| 5,314,394 | 5/1994 | Ronan | 482/104 |
| 5,407,403 | 4/1995 | Coleman | 482/6 |

*Primary Examiner*—Richard J. Apley
*Assistant Examiner*—John Mulcahy
*Attorney, Agent, or Firm*—John R. Duncan; Frank D. Gilliam

[57] ABSTRACT

An apparatus for improving fitness and muscle rehabilitation which includes a horizontal base having an upwardly extending structure secured thereto. A seat is provided at the lower end so that a user may sit with legs extended up the slope. A carriage is mounted for movement along the structure, with a seat oriented so that a user can selectively push the carriage upwardly or restrain carriage movement downwardly. A power drive selectively moves the carriage up and down the structure at a desired rate against which the user works. Multiple safety devices are included to prevent the carriage from moving down the slope beyond a selected point and to prevent the carriage from moving at a speed beyond a selected rate. A convenient control box is provided for operating the apparatus in a selected mode.

19 Claims, 2 Drawing Sheets

CONCENTRIC/ECCENTRIC EXERCISE APPARATUS

BACKGROUND OF THE INVENTION

This invention relates to automated apparatus for exercise, physical development and rehabilitation that can provide selected levels of positive and negative exercises.

A very wide variety of devices have been developed for achieving muscular development. For example, isokinetic devices of the sort described by Sparks in U.S. Pat. No. 4,483,532 regulate and control the rate of muscular contraction regardless of the force applied to the device by the user's muscular contractions.

Many devices provide for positive only, or noneccentrically, loaded use. Typically, these devices provide regulated resistance when a bar or the like is lifted or moved, such as the hydraulic system described by Ariel in U.S. Pat. No. 4,354,676 or the electrically controlled friction system shown by Wilson in U.S. Pat. No. 4,063,726.

While these devices only apply variable positive resistance others provide the highly desirable concentric and eccentric resistance on the positive and negative strokes. Typical of these is the weight lifting apparatus described by Sidwell in U.S. Pat. No. 4,765,610 and the power training apparatus described by Wolf in U.S. Pat. No. 4,741,530. While these are generally useful, they are primarily concerned with upper body development and are not particularly adapted to the development of lower body muscles through leg presses and the like.

Many exercise devices now incorporate microprocessor based control and measurement equipment to allow convenient selection of exercise variations and to record the user's progress. Typical of these are the systems described by Paterson et al. in U.S. Pat. No. 4,865,315 and Baker in U.S. Pat. No. 4,930,770. While generally helpful, these systems do not always provide the highest degree of safety, in particular during eccentric exercise without aid of a trainer and tend to be complex and expensive.

Thus, there is a continuing need for improvements in is concentric/eccentric exercise apparatus adaptable to the development of different muscle groups and which provide particularly desirable eccentric movement and improved safety.

SUMMARY OF THE INVENTION

The above-noted problems, and others, are overcome by the apparatus of this invention which basically comprises a generally horizontal base and a sloping structure secured to said base at the lower end, a seat at the lower end for supporting a user with legs extending along the sloping structure, a weighted carriage movable along the structure by a user's feet.

In order to move the carriage in a manner providing a predetermined concentric and/or eccentric resistance to movement by the user, an idler pulley is mounted on the upper end of the sloping structure with a cable fastened to the carriage running over the idler pulley to a powered spool mounted on the apparatus which winds and unwinds cable. The powered spool is rotatable in either direction by a variable speed electric motor operating through a gear box or the like.

The powered spool is operated to move the carriage upwardly or downwardly along the sloping structure at a predetermined speed through a control assembly, operably by the user or a nearby trainer. Limits for the extent of upward and downward movement of the carriage can be set. The speed of powered upward and downward movement may also be set.

An automatic safety device is included to stop movement of the carriage if predetermined speed limits are exceeded. The safety device includes at least one strap wound on an inertial reel of the sort used in conventional automobile seat belts. The strap is connected between the moving weighted portion and a fixed portion of the assembly. If the moving weight descends at a speed above a predetermined speed, the inertial reel locks to prevent further movement in the same manner as an automobile seat belt restrains an occupant in the event of an impact and the resulting sudden, fast movement. The system is reset by simply lifting the weight slightly.

For even greater safety, a plurality of spaced holes are provided along the sloping structure into which projecting pegs can be inserted at desired locations, so that a part of the carriage structure will be contacted to stop further downward carriage movement.

While the detailed description describes a preferred embodiment primarily intended to develop leg muscles, the assembly can be oriented at other angles, from nearly horizontal to vertical, so that the weight can be moved by other muscle groups.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
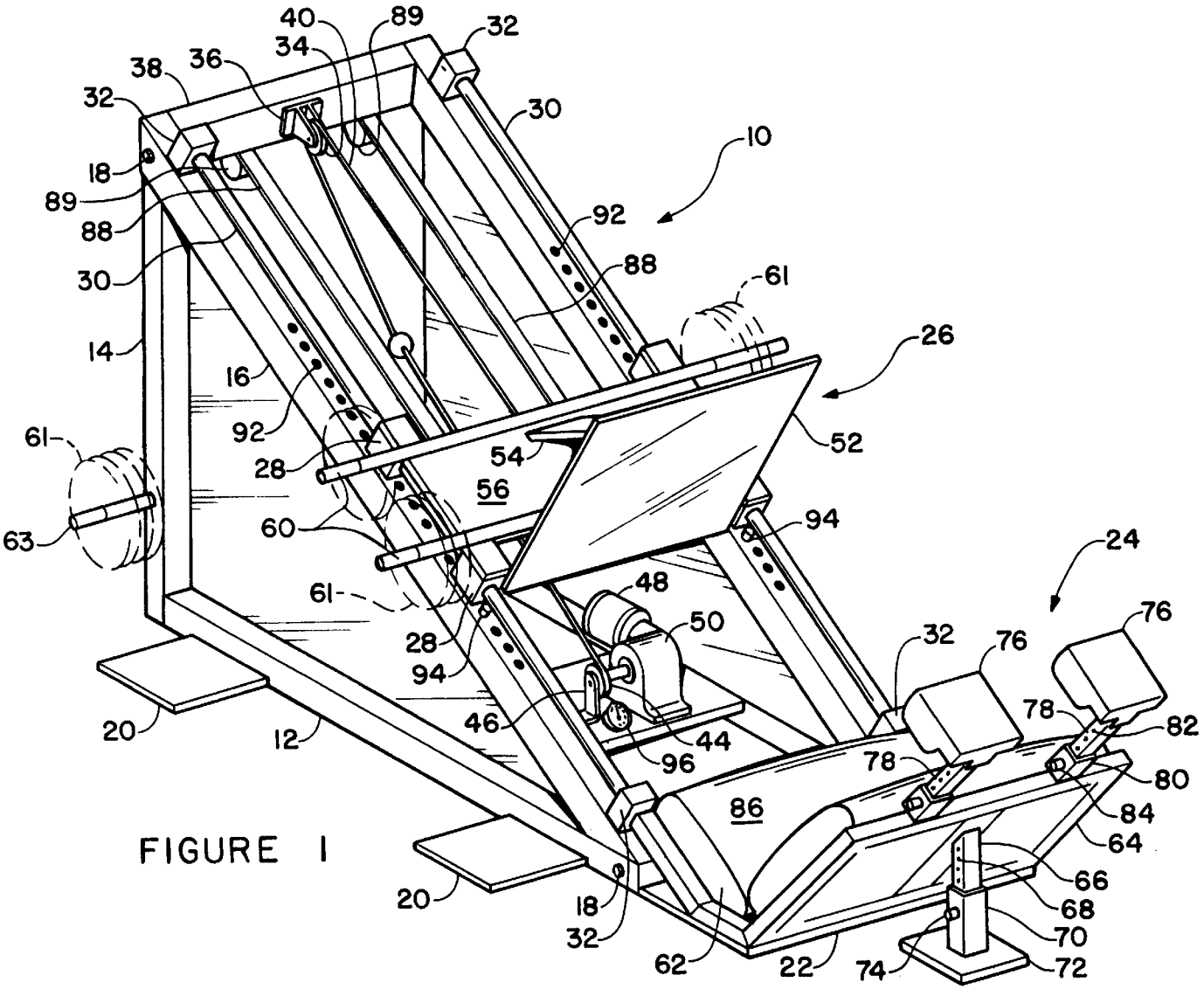
FIG. 1 is a schematic perspective view of the exercise apparatus of this invention.
Figures 2, 3:
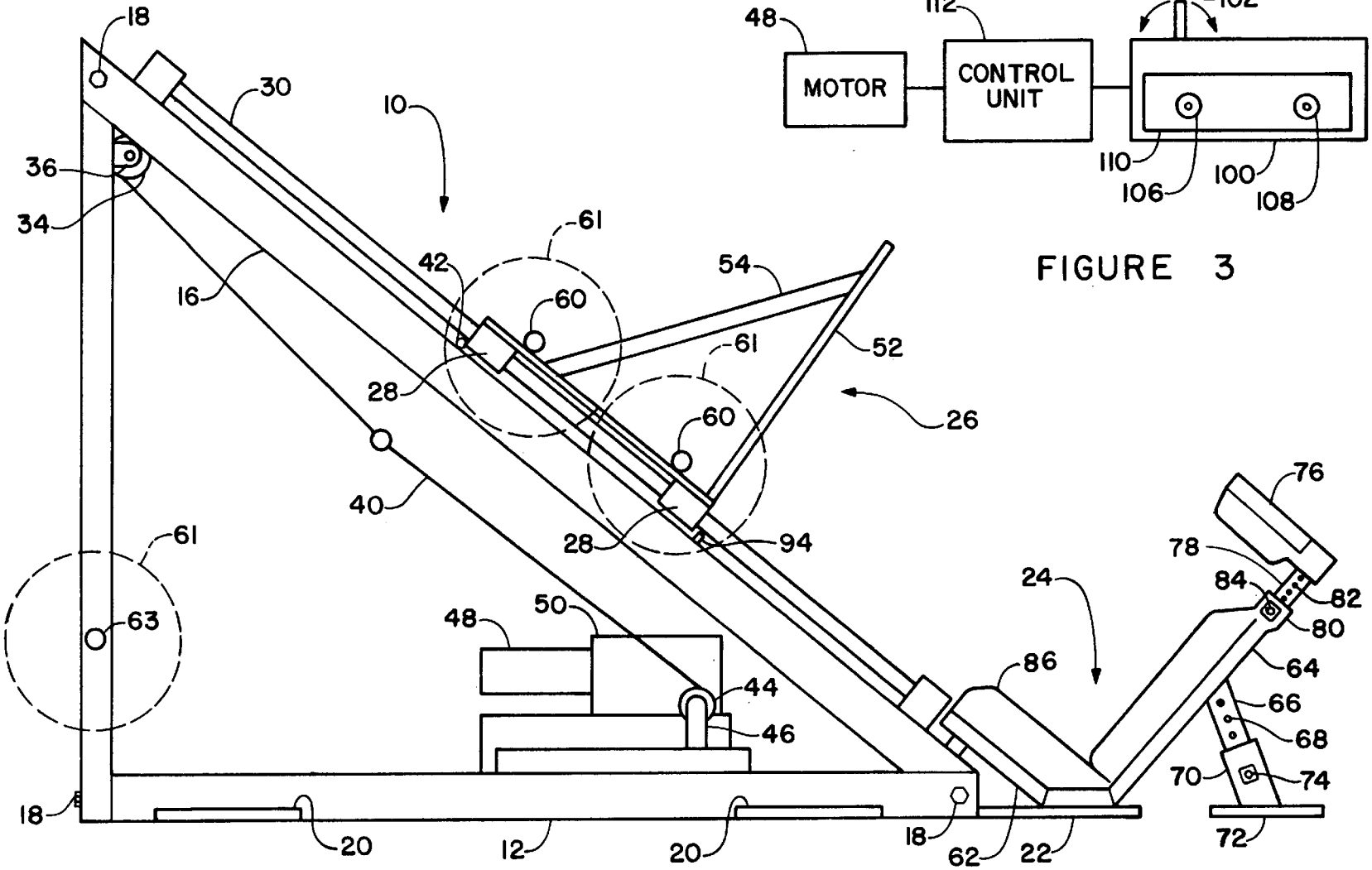
FIG. 2 is a side elevation view of the apparatus with covers removed.
FIG. 3 is a schematic diagram of a control box for controlling operation of the exercise apparatus.

Referring to FIGS. 1 and 2, there is seen an exercise apparatus 10 basically comprising a base frame 12, an upright frame 14 and a sloping structure 16, together preferably a right triangular assembly. Typically each of these components are formed from metal angles, channels and plates secured together by welding, bolts, etc. Preferably the frames 12 and 14 and sloping structure are each a unitary component, to be assembled on site with bolts 18 for ease of breakdown and transport.

Preferably, base frame 12 is a rectangular metal channel, angle or box structure with transverse plates 20 welded thereto and extending beyond the frame sides about 14 inches for lateral stability. Two metal plate extensions 22 are provided at the intersection of base frame 12 and the lower end of sloping support 16 as a support for seat 24 as detailed below.

The sides and back of apparatus are covered with removable thin metal or plastic panels for further structural rigidity, appearance and to keep user body parts away from potentially dangerous internal components. Preferably, the covers are transparent so that a trainer can observe operation of the internal components during use.

While any suitable material can be used for the apparatus, including metals and reinforced plastics, metal such as steel and aluminum is preferred for strength and durability.

A carriage 26 is mounted for movement up and down sloping structure 16. Carriage 26 rides on conventional linear bearings (not seen) in box section 28 which ride on shafts 30, typically 1½ inch diameter, Rockwell 60 stainless steel shafts. Shafts 30 are mounted on sloping support 16 by shaft supports 32 at each shaft end. Shafts 30 are arranged to allow carriage 26 to move at an angle to horizontal of between 20° and 70°.

An idler pulley 34 is mounted in a centered bracket 36, attached to crosspiece 38 at the intersection of the top end of upright frame 14 and the upper end of sloping structure 16. A cable 40 is fastened to bar 42 at the upper center of carriage 26 and runs over idler pulley 34 to a powered drive spool 44 mounted between pillow blocks 46 and driven by a variable speed, reversible, motor 48 through a speed reducing gear box 50. Typically, motor 48, gear box 50 and drive spool 44 and will be selected to provide a carriage movement rate of from about 10 to 20 inches per second. A slack weight 51 is preferably provided along cable 40 so that if cable 40 should become slack at any point, such as when components of the apparatus are being adjusted, sufficient tension will be maintained on the cable so that it will not loosen and foul spool 44. Also, a trainer can observe the position of the weight 51 during use, since the degree of slack (and resulting lower position of weight 51) will directly indicate the force being applied by a user.

Carriage 26 includes a foot rest 52, a central brace 54 extending between foot rest 52 and a longitudinal plate 56 fastened to bars 42. A user seated in seat 24 can push against foot rest 52 with his or her feet. If desired, foot rest 52 can be covered with a resilient material, such as textured grip tape or carpet. If the assembly is vertically oriented and intended to develop upper body muscle groups, seat 24 can be reoriented to allow a person to sit with the hands engaging suitable handles on carriage 26.

One or more (two being shown) round bars 60 are secured across carriage 26 and extend to the side of the apparatus for receiving and supporting weights 61. Typical weights are heavy metal disks with central apertures sized to slide onto bars 60 and be retained by conventional means, such as shaft collars with setscrews. A bar 63 preferably is secured to upright frame 14 and extends beyond the sides to store weights 61 not in use.

Seat assembly 24 includes a preferably padded seat 62 and back 64, supported on plates 22. Back 64 is hinged along the lower edge so that the back angle can be adjusted by moving a rail 66 (hingedly mounted on seat back 64) having spaced transverse holes 68 to a desired position in sleeve 70 mounted on support plate 72. A spring-loaded pin assembly 74 extends through an opening in the side of sleeve 70 so that a pin can be inserted through any of holes 68 to lock seat back at the selected angle to seat 62. A pair of shoulder bars 76 are mounted on rail 78 which is inserted into a sleeve 80 secured to seat back 64. Transverse holes 82 in rail 78 and locking pin assembly 84 on sleeve 80 cooperate to position shoulder bars 76 at the desired position relative to a user seated in seat assembly 24. Preferably, high density padding 86 is formed over the surface of shoulder bars 76 that contact a user's shoulders. Shoulder bars 76 prevent a user from sliding upwardly along back 64 when exerting lifting pressure with his or her legs.

If for any reason a heavily weighted carriage 26 should be released from all restraint during use, such as a failure in the electronic control system, breaking or release of cable 40, etc., a user could be seriously injured. In order to prevent such an occurrence and injury, three separate safety systems are provided.

Two safety straps 88 are connected between back frame crosspiece 38 and carriage bar 42 to limit the downward speed of carriage 26. Any suitable number of straps, one or more may be used, as desired. Preferably, straps 88 are equivalent to the half of a conventional automobile lap belt assembly that includes the inertial reel. If downward speed exceeds a predetermined rate, the inertial reel 89 will lock up and prevent further movement. The reel can be reset by simply pushing the carriage up the track slightly.

A second safety device to prevent downward movement of carriage 26 along sloping support 16 beyond a selected point is provided. A plurality of spaced holes 92 are formed along the upper surface of side members of the sloping frame. Simple cylindrical metal pegs 94 are provided for insertion in selected holes 92. Bar 42 moves adjacent to the surface bearing holes with carriage 26. Thus, pegs 94 are inserted along each side of sloping support 16 so that bar 42 will contact them and prevent further carriage movement down the sloping support.

FIG. 2 shows a schematic representation of a preferred control box 100 for operating apparatus 10. Control box 10 is adapted to being hand held by the user. A pivoting lever switch 102 is movable in one direction to close contacts that cause motor 48 to move in a first position moving carriage 26 upwardly for concentric exercise and in the opposite direction to close contacts that cause motor 48 to move carriage 26 downwardly for eccentric exercise. Preferably, switch 102 is spring loaded to the central "off" position so that simply releasing the switch will cause carriage 26 to stop moving. Two speed control knobs are provided on control box 100, to control the speed of motor 48 in a conventional manner, such as though variable potentiometers.

Control 106 adjusts the upward carriage lift speed for concentric exercise, while control 108 adjusts downward carriage speed for eccentric exercise. Preferably, a hinged transparent, typically plastic, cover 110 is provided over control knobs 106 and 108 to prevent inadvertent speed changes during exercise. Control box 100 is wired to control unit 112 at the motor and includes a conventional speed monitor, typically a tachometer, conventional limit switches and a speed braking unit activated when a carriage overspeed condition is sensed (any conventional braking system, either mechanical or electronic may be used). If desired, more than one control box 100 can be connected to control unit. Typically, one would be operated by the person exercising and another by a trainer supervising the exercise. If desired, the control box 100 operated by the trainer could be arranged to override that operated by the person using the apparatus.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. Concentric/eccentric fitness and rehabilitation apparatus which comprises:

a base;

a structure secured to said base at a lower end and having an elevated upper end;

a seat at said lower end for supporting a user;

a weighted carriage for movement along said structure and engagable by a user;

carriage movement means comprising an idler pulley secured at said upper end, a powered spool mounted in said apparatus and a cable secured to said carriage and extending over said idler pulley to said powered spool;

means for rotating said powered spool in either direction comprising a control lever movable between an upward carriage movement position, a carriage stopped position and a downward carriage movement position and spring means for moving said control lever to said carriage stopped position when released by a user;

control means including means for selectively rotating said powered spool to move said carriage upwardly or downwardly along said structure at a predetermined speed, means for stopping downward movement of said carriage at a predetermined limit; and safety means for stopping carriage downward movement in the event of downward speed beyond a predetermined rate.

2. The apparatus according to claim 1 wherein said control means further includes means for setting said lower limit at desired points.

3. The apparatus according to claim 1 wherein said control means further includes means for setting upward carriage movement speed.

4. The apparatus according to claim 3 wherein said control means further includes means for separately setting downward carriage speed.

5. The apparatus according to claim 4 wherein said control means is incorporated in a unitary box adapted to be held by a user, said box including a hinged transparent cover over said speed control means to prevent inadvertent speed changes.

6. The apparatus according to claim 1 wherein said means for stopping carriage downward movement comprises at least one bar in said structure along which said carriage rides, a plurality of holes along said bar, a plurality of pegs for insertion in predetermined ones of said holes and stop means on said carriage for engaging said pegs and preventing further descent of said carriage along said structure.

7. The apparatus according to claim 1 wherein said safety means comprises at least one belt connected between said upper end of said structure and said carriage and a self-retracting inertial reel around which a portion of said belt is wound to stop further downward movement of said carriage when a predetermined downward speed is exceeded.

8. The apparatus according to claim 1 further including means extending transverse to said carriage for receiving predetermined quantities of weight.

9. The apparatus according to claim 1 wherein said carriage movement means comprises an electric motor and gear box for reversibly rotating said powered spool, said drive means being located below said structure adjacent to said seat and further including a slack weight on said cable between said powered spool and idler pulley.

10. The apparatus according to claim 1 wherein said structure is oriented to allow said carriage to move at an angle to horizontal between about 20° and 70°, said seat is configured to support a user with legs extending upwardly along said structure and said carriage is configured to be engaged by a user's feet.

11. Concentric/eccentric fitness and rehabilitation apparatus which comprises:

a generally horizontal base;

a sloping structure secured to said base at a lower end and having an elevated upper end;

a seat at said lower end for supporting a user with legs extendable along said sloping structure;

a weighted carriage for movement along said sloping structure and engagable by a user's feet;

carriage movement means comprising an idler pulley secured at said upper end, a powered spool mounted in said apparatus and a cable secured to said carriage and extending over said idler pulley to said powered spool;

means for rotating said powered spool in either direction comprising a control lever movable between an upward carriage movement position, a carriage stopped position and a downward carriage movement position and spring means for moving said control lever to said carriage stopped position when released by a user;

control means including means for selectively rotating said powered spool to move said carriage upwardly or downwardly along said structure at a predetermined speed, means for stopping downward movement of said carriage in the event of downward speed beyond a predetermined rate;

safety means for preventing further downward movement of said carriage past a predetermined point; and said safety means comprising at least one belt connected between said upper end of said sloping structure and said carriage and a self-retracting inertial reel around which a portion of said belt is wound to stop further downward movement of said carriage when a predetermined downward speed is exceeded.

12. The apparatus according to claim 11 wherein said control means further includes, means for setting carriage upward movement speed and means for setting carriage downward movement speed.

13. The apparatus according to claim 11 wherein said safety means comprises at least one bar in said structure along which is said carriage rides, a plurality of holes along said bar, a plurality of pegs for insertion in predetermined ones of said holes and stop means on said carriage for engaging said pegs and preventing further descent of said carriage along said structure.

14. The apparatus according to claim 11 wherein said carriage movement means comprises an electric motor and gear box for reversibly rotating said powered spool, said drive means being located below said structure adjacent to said seat and further including a slack weight on said cable between said powered spool and idler pulley.

15. The apparatus according to claim 11 further including means extending transverse to said carriage for receiving predetermined quantities of weight.

16. Concentric/eccentric fitness and rehabilitation apparatus which comprises:

a base;

a structure secured to said base at a lower end and having an elevated upper end;

a seat at said lower end for supporting a user;

a weighted carriage for movement along said structure and engagable by a user;

carriage movement means comprising an idler pulley secured at said upper end, a powered spool mounted in said apparatus and a cable secured to said carriage and extending over said idler pulley to said powered spool;

means for rotating said powered spool in either direction;

control means including means for selectively rotating said powered spool to move said carriage upwardly or downwardly along said structure at a predetermined speed, means for stopping downward movement of said carriage at predetermined limits;

safety means for stopping carriage downward movement in the event of downward speed beyond a predetermined rate; and said safety means comprising at least one belt connected between said upper end of said sloping structure and said carriage and a self-retracting inertial reel around which a portion of said belt is wound to stop further downward movement of said carriage when a predetermined downward speed is exceeded.

17. The apparatus according to claim 16 wherein said control means further includes means for setting said upper and lower limits at desired points.

18. The apparatus according to claim 16 wherein said control means further includes means for setting upward carriage movement speed.

19. The apparatus according to claim 18 wherein said control means further includes means for separately setting downward carriage speed.

* * * * *